US011173986B2

(12) United States Patent
Bennett

(10) Patent No.: US 11,173,986 B2
(45) Date of Patent: Nov. 16, 2021

(54) FIN MOUNT FOR AN INFLATABLE WATERCRAFT

(71) Applicant: Brett Mathew Bennett, Katsuura (JP)

(72) Inventor: Brett Mathew Bennett, Katsuura (JP)

( * ) Notice: Subject to any disclaimer, the term of this patent is extended or adjusted under 35 U.S.C. 154(b) by 4 days.

(21) Appl. No.: 15/931,540

(22) Filed: May 13, 2020

(65) Prior Publication Data

US 2020/0361575 A1 Nov. 19, 2020

Related U.S. Application Data

(60) Provisional application No. 62/847,173, filed on May 13, 2019.

(51) Int. Cl.

| | |
|---|---|
| ***B63B 32/66*** | (2020.01) |
| ***B63B 34/22*** | (2020.01) |
| ***B63B 32/51*** | (2020.01) |
| ***B63B 32/60*** | (2020.01) |

(52) U.S. Cl.

CPC ..... *B63B 32/66* (2020.02); *B63B 32/51* (2020.02); *B63B 32/60* (2020.02); *B63B 34/22* (2020.02)

(58) Field of Classification Search

CPC ..... B63B 32/51; B63B 32/60; B63B 32/62; B63B 32/64; B63B 32/66; B63B 34/22; B63B 34/23; B63B 34/26; B63B 39/06

See application file for complete search history.

(56) References Cited

U.S. PATENT DOCUMENTS

| | | | | |
|---|---|---|---|---|
| 4,789,368 | A * | 12/1988 | D'Onofrio | B63B 32/70 441/79 |
| 9,694,540 | B2 | 7/2017 | Trockel | |
| 9,809,285 | B1 * | 11/2017 | Yeh | B63B 32/60 |
| 10,077,097 | B1 * | 9/2018 | Cheung | B63B 32/66 |
| 10,086,918 | B2 | 10/2018 | Pepper et al. | |
| 10,906,614 | B2 * | 2/2021 | Sebastjan | B63B 32/66 |

FOREIGN PATENT DOCUMENTS

| | | | | |
|---|---|---|---|---|
| EP | 0900724 | A2 | 3/1999 | |
| FR | 2594785 | A1 * | 8/1987 | B63B 32/66 |
| WO | WO2000009222 | A2 | 2/2000 | |
| WO | WO2013057395 | A1 | 4/2013 | |

OTHER PUBLICATIONS

Air7 Fin Systems, http://www.air7.net/#products.

* cited by examiner

*Primary Examiner* — Ajay Vasudeva

(57) ABSTRACT

A fin mount for an inflatable watercraft is an apparatus used as a universal fin box that connects a variety of fins. The apparatus includes a clamp and a fin. The clamp mounts the fin into a fin box-receiving hole of an inflatable watercraft. The clamp includes a lower press, an upper press, and a length-adjustable fastener. The lower press and the upper press seal the fin box-receiving hole. The lower press and the upper press tighten together with the length-adjustable fastener. The lower press and the upper press tensionably tether to each other by the length-adjustable fastener. The apparatus further includes a fin-attachment mechanism that secures the fin into the lower press. The fin removably attaches into a fin-receiving slot of the lower press. The apparatus further includes a plurality of lower counterforts and a plurality of upper counterforts which structurally reinforce the lower press and the upper press.

20 Claims, 7 Drawing Sheets

FIN MOUNT FOR AN INFLATABLE WATERCRAFT

The current application claims a priority to the U.S. provisional patent application Ser. No. 62/847,173 filed on May 13, 2019.

FIELD OF THE INVENTION

The present invention generally relates to inflatable watercrafts. More specifically, the present invention is a fin mount for an inflatable watercraft.

BACKGROUND OF THE INVENTION

In present times, individuals are known to utilize a variety of watercraft to participate in maritime activities. Of particular interest for the purposes of the present invention, inflatable watercraft such as surfboards, paddleboards (particularly stand-up paddleboards), kayaks, and other craft are known to utilize externally fixed hydrodynamic fins to stabilize these craft as they move through the water, while simultaneously granting riders a greater degree of control over their course. These fins may be permanently adhered to the hulls of such craft or may be detachable via the use of fin boxes. Fin boxes are understood to embody a variety of different forms in the present market; including kits to adhere a fin box to the outer hulls of craft, rigid boxes intended to be "glassed in" (molded in to a hull via fiberglass substrate and resin), and systems that rely on the tension created between the outer layers of an inflatable body to fix a fin box in position. It is understood that the methods of attachment involving adhesives and composite-molding are irreversible, constituting a permanent modification of any hull subject to attachment of fins by these means. A user may not be willing to risk permanent damage to the hull via improper installation or may have reservations about committing to a single type of fin box, making these systems undesirable. It is further contemplated that the rigid inserts used in conjunction with inflatable hulls may not be suitable for use with a variety of hulls, requiring a specific distance between the hull-side and deck-side structures to enable effective fixture of such fin boxes into any given hull.

The present invention offers users an adjustable means of fixing any type or variety of fins to any suitable equipped inflatable or rigid hull, requiring only an internal cavity suitable for use with nay fin box presently known in the field. Vertical adjustment may be achieved by adjusting integrated components of the present invention, requiring no tools to make such adjustments. The present invention is configured to require no permanent modification of a hull, provided that said hull is presently capable of accepting a fin box intended to be fixed traversing the width of the hull as described herein.

DETAIL DESCRIPTIONS OF THE INVENTION

Figure 1:
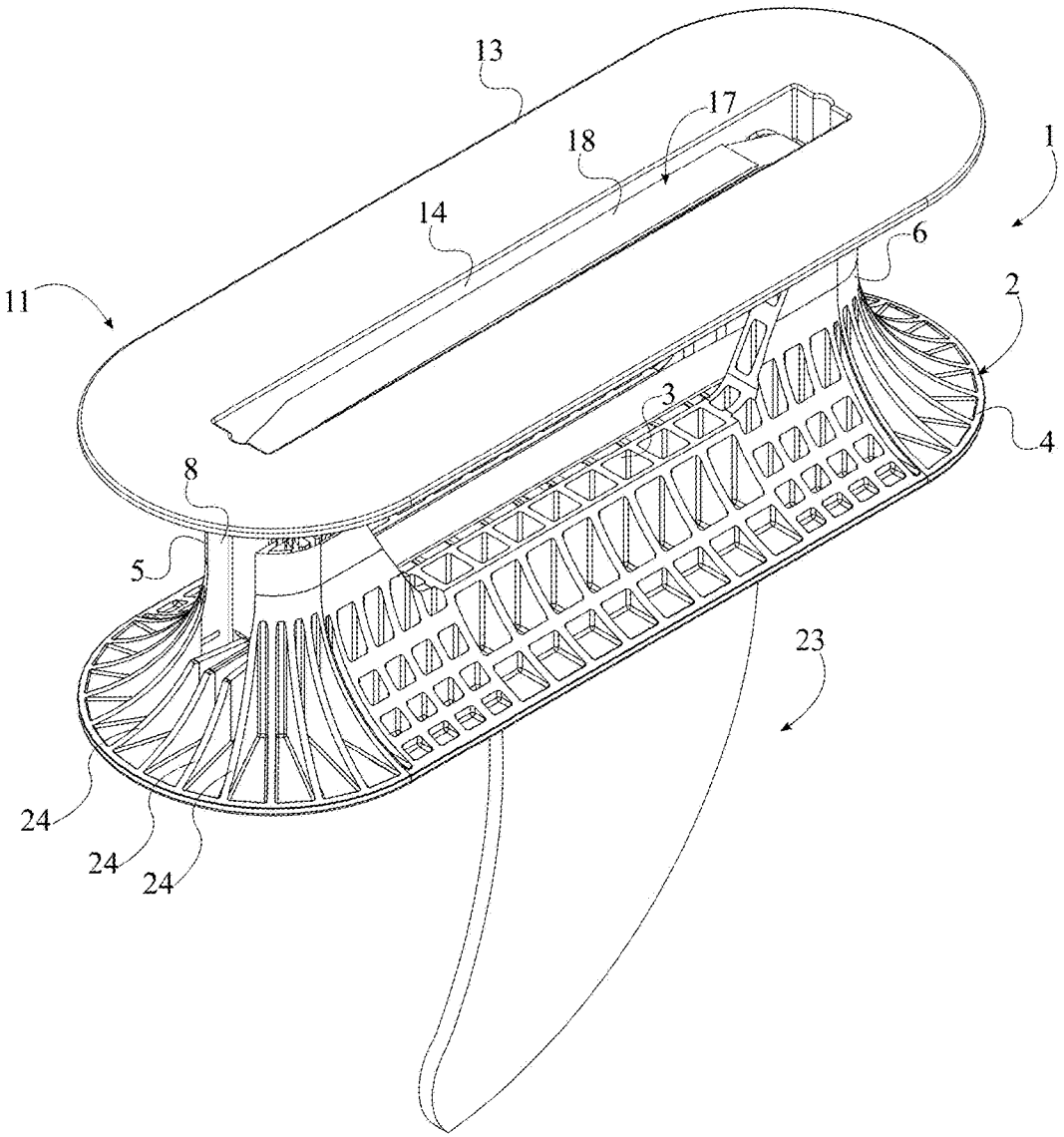
FIG. 1 is a top perspective view of the present invention.

All illustrations of the drawings are for the purpose of describing selected versions of the present invention and are not intended to limit the scope of the present invention.

The present invention is a fin mount for an inflatable watercraft that serves as a universal accessory for a variety of inflatable watercrafts. The present invention accommodates varying thicknesses of inflatable watercrafts. The present invention securely attaches a fin underneath an inflatable watercraft. The inflatable watercraft may include, but is not limited to, a paddleboard, a surfboard, and a kayak. The present invention is integrated through a fin box-receiving hole of an inflatable watercraft and is readily removable after use of the watercraft. In for the present invention be secured within the fin box-receiving hole, the present invention comprises a clamp 1 and a fin 23, seen in FIG. 1. The clamp 1 provides a secure connection between the inflatable watercraft and the fin 23. The fin 23 enhances the stability of the inflatable watercraft and increases the control of inflatable watercraft for the user. The clamp 1 adjusts to varying thicknesses of inflatable watercrafts as the clamp 1 comprises a lower press 2, an upper press 11, and an adjustable fastener 31. The lower press 2 seals the fin box-receiving hole along the underside of the inflatable watercraft, and the upper press 11 seals the fin box-receiving hole along the topside of the inflatable watercraft. The length-adjustable fastener 17 tightens the lower press 2 and the upper press 11 with the inflatable watercraft. The lower press 2 comprises a lower elongated body 3, a lower stopper rim 4, a first arm 5, a second arm 6, and a fin-receiving slot 7. The lower elongated body 3 traverses across the fin box-receiving hole, and the lower stopper rim 4 seals the lower elongated body 3 with the inflatable watercraft. The first arm 5 and the second arm 6 stabilize the lower press 2 with the upper press 11 and secures both the position and the orientation of the clamp 1 within the fin box-receiving hole. More specifically, the first arm 5 and the second arm 6 orients and positions the length-adjustable fastener 17 around the lower press 2 and the upper press 11. The fin-receiving slot 7 allows the fin 23 to attach within the lower press 2. In order to seal the fin box-receiving hole along the topside of the inflatable watercraft, the upper press 11 comprises an upper elongated body 12 and an upper stopper rim 13. The upper elongated body 12 traverses across the fin box-receiving hole, and the upper stopper rim 13 seals the upper elongated body 12 with the inflatable watercraft.

Figure 2:
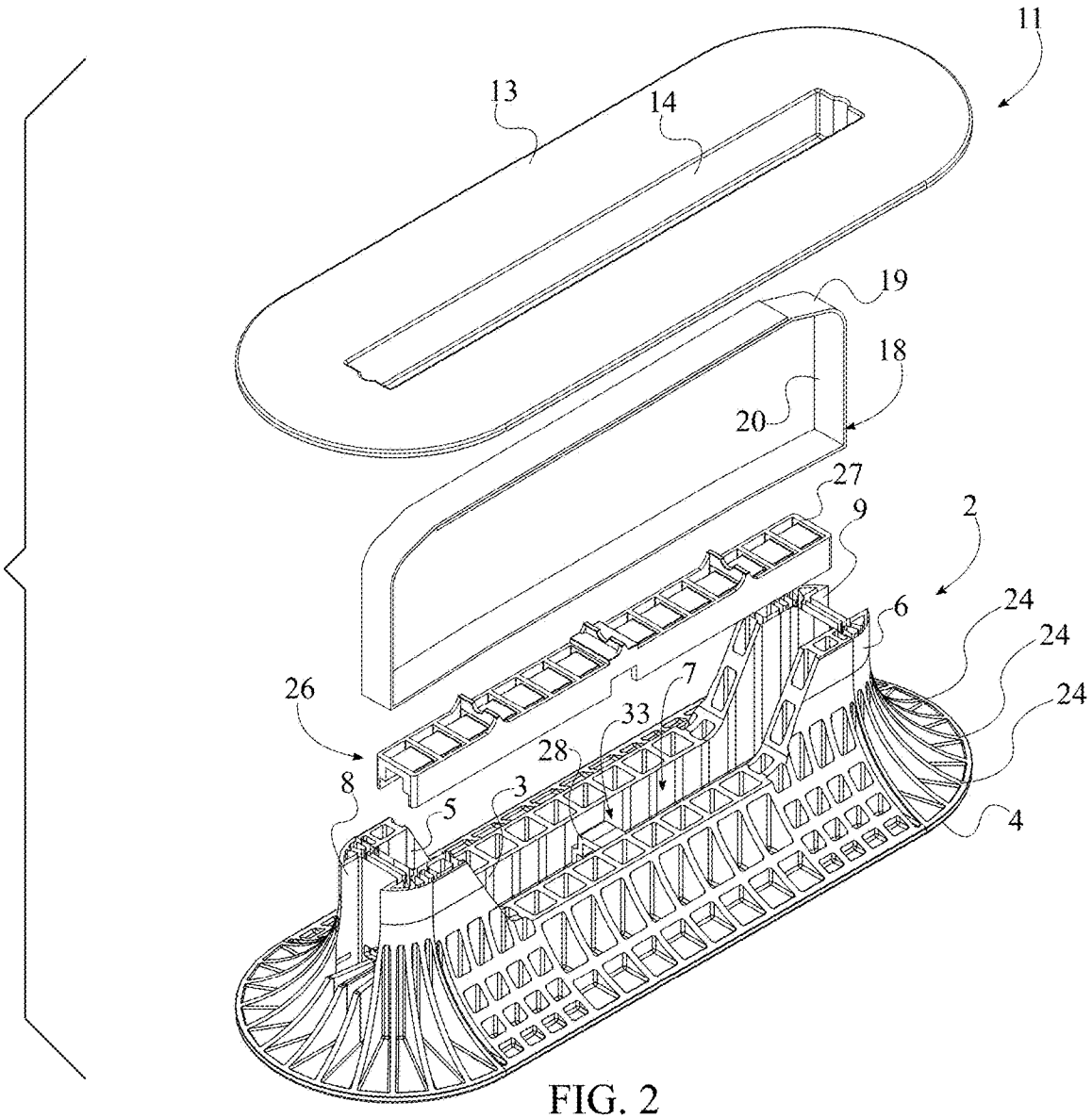
FIG. 2 is a top exploded view of a clamp and a fin-attachment mechanism of the present invention.
Figure 3:
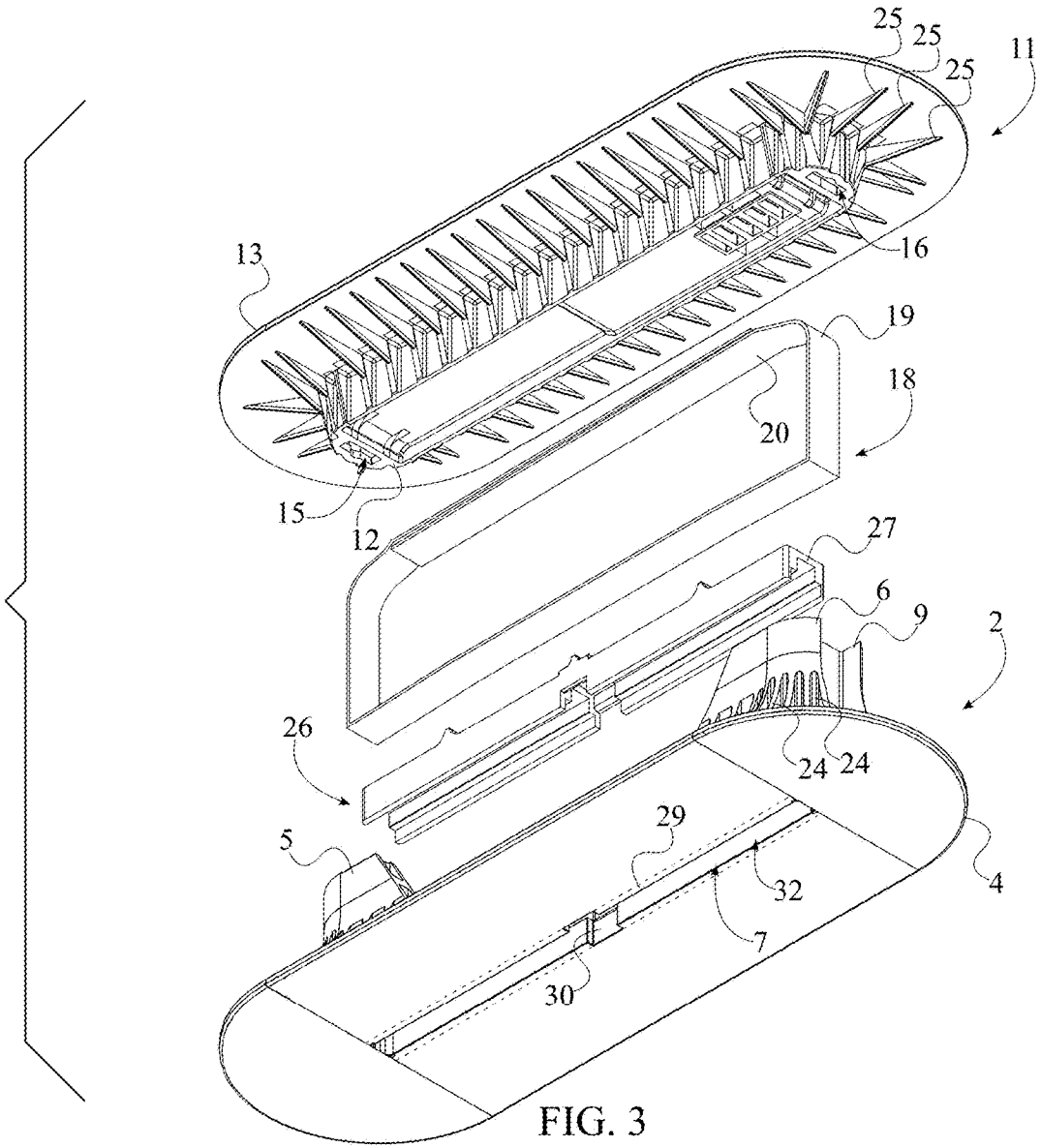
FIG. 3 is a bottom exploded view of the clamp and the fin-attachment mechanism of the present invention.

The overall arrangement of the aforementioned components effectively seals a fin box-receiving hole of an inflatable watercraft while mounting a fin 23. As seen in FIG. 1, FIG. 2, and FIG. 3, the lower stopper rim 4 is laterally fixed around the lower elongated body 3 so that the lower press 2 extends over the inflatable watercraft while positioned within the fin box-receiving hole. The first arm 5 and the second arm 6 are laterally fixed to the lower elongated body 3, opposite the lower stopper rim 4 thereby structurally reinforcing the lower press 2 with the upper press 11 within the fin box-receiving hole. Moreover, the length-adjustable fastener 17 is stabilized around both the lower press 2 and the upper press 11 as the first arm 5 and the second arm 6 are positioned opposite to each other along the lower elongated body 3 and positioned perpendicular with the lower elongated body 3. The fin-receiving slot 7 is positioned in between the first arm 5 and the second arm 6 and traverses through the lower elongated body 3, further preserving the structural integrity of the present invention while engaged with an inflatable watercraft. Similar with that of the lower press 2, the upper stopper rim 13 is laterally fixed around the upper elongated body 12, so that the upper press 11 extends over the inflatable watercraft while positioned within the fin box-receiving hole. Moreover, the upper press 11 is securely positioned within the fin box-receiving hole as the upper elongated body 12 is positioned adjacent with the first arm 5 and the second arm 6, opposite the lower elongated body 3. The fin 23 is removably attached into the fin-receiving slot 7, and the fin 23 is positioned opposite to the first arm 5 and the second arm 6 about the lower elongated body 3. This attaches the fin 23 with the clamp 1 and orients the fin 23 underneath the inflatable watercraft. The clamp 1 seals the fin box-receiving hole as the upper press 11 and the lower press 2 are tensionably tethered to each other by the length-adjustable fastener 17.

Figure 6:
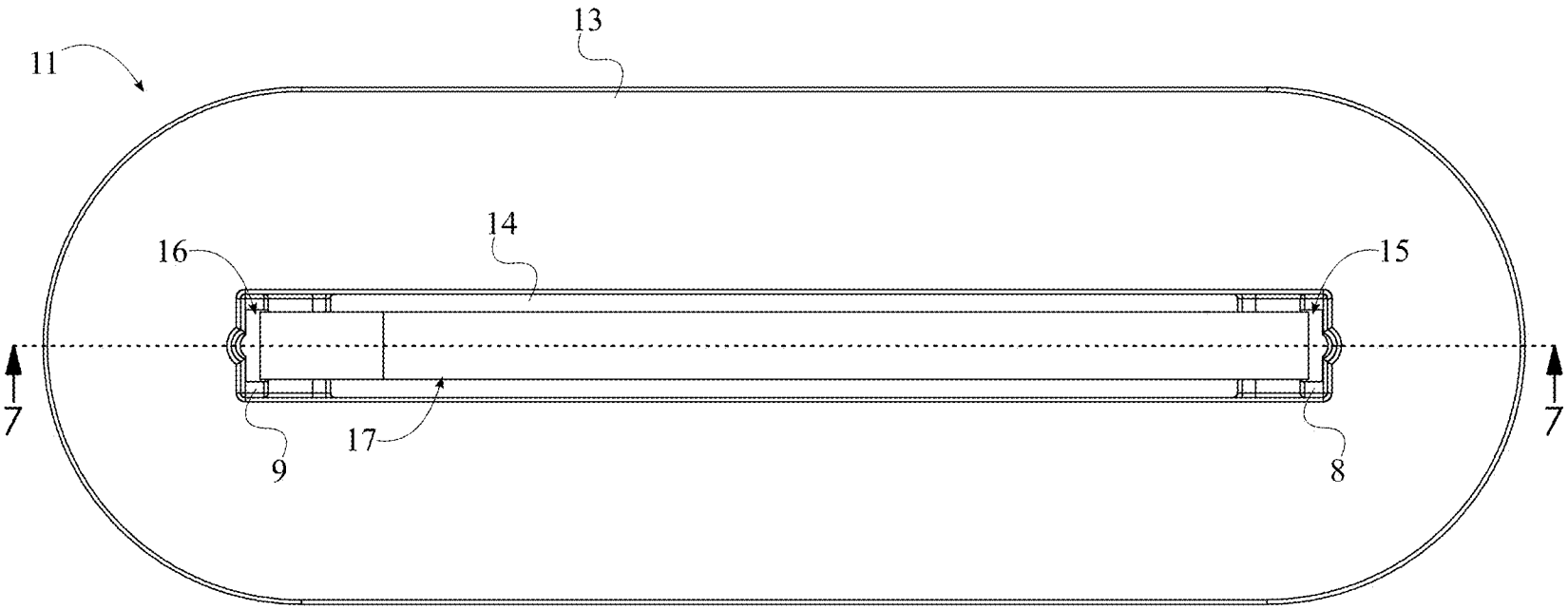
FIG. 6 is a top side view of the present invention.
Figure 7:
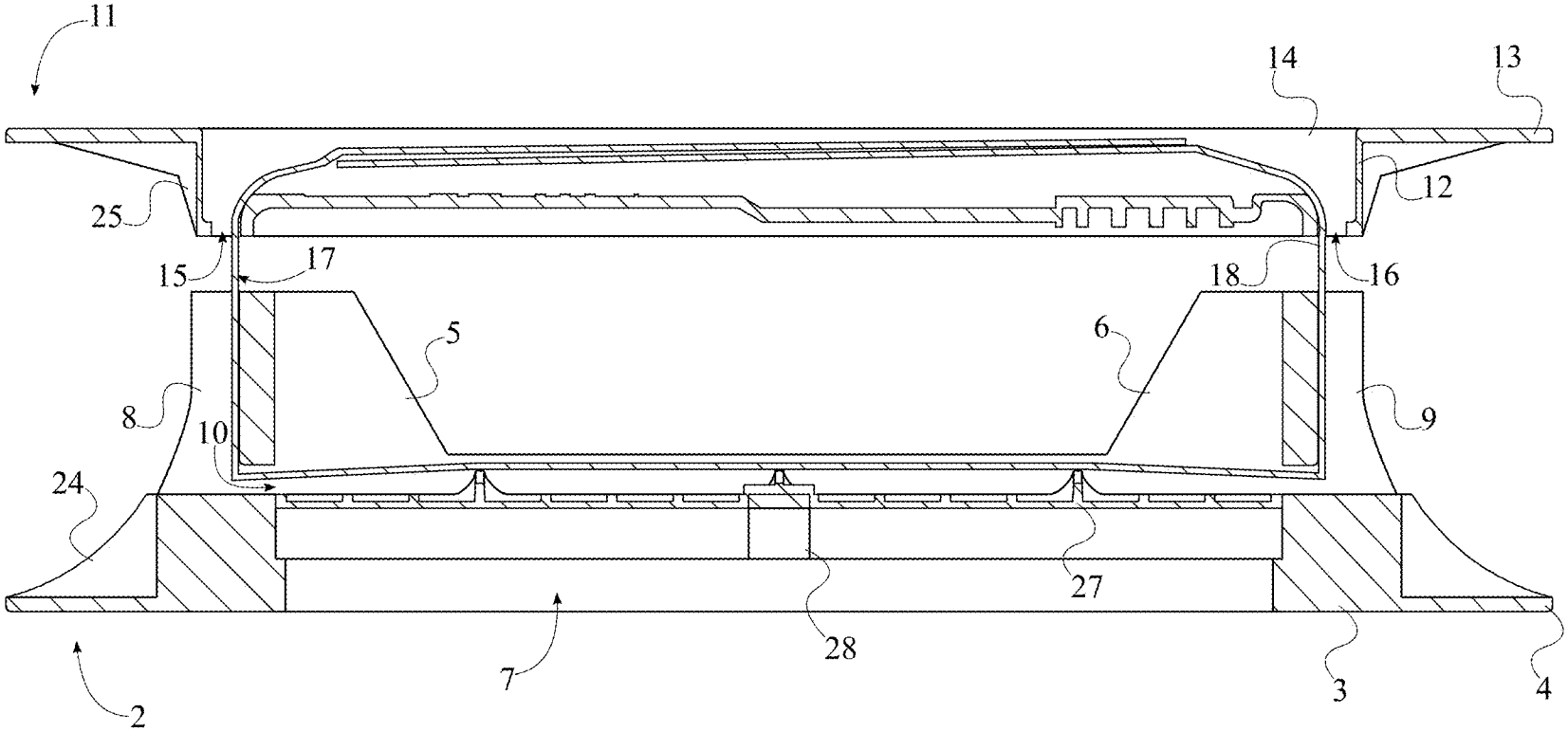
FIG. 7 is a cross-section view taken along line 7-7 in FIG. 6.

In order for the length-adjustable fastener 17 to be secured around the lower press 2 and the upper press 11, the lower press 2 further comprises a first track 8, a second track 9, and a channel 10, seen in FIG. 2 and FIG. 7. The upper press 11 further comprises a bed 14, a first slot 15, and a second slot 16, seen in FIG. 2, FIG. 3, and FIG. 6. The first track 8 and the second track 9 position the length-adjustable fastener 17 across the first arm 5 and the second arm 6, respectively. The length-adjustable fastener 17 continuously traverses into the first track 8 and the second track 9 with the channel 10. The bed 14 allows the length-adjustable fastener 17 to be flushed with the upper press 11. The length-adjustable fastener 17 wraps around the upper press 11 while positioned within bed 14 through the first slot 15 and the second slot 16. In order for the lower press 2 to be stabile with the upper press 11 while tensionably tethered with the upper press 11, the first track 8 is integrated along the first arm 5, and the second track 9 is integrated along the second arm 6. The length-adjustable fastener 17 continuously traverses around the lower press 2 as the channel 10 is integrated along the lower elongated body 3 and traverses from the first track 8 to the second track 9, across the lower elongated body 3. The length-adjustable fastener 17 continuously extends into the upper press 11 as the first slot 15 and the second slot 16 traverse through the upper elongated body 12. More specifically, the first slot 15 is positioned opposite the second slot 16 along the upper elongated body 12. This arrangement stabilizes the length-adjustable fastener 17 around the upper press 11. The length adjustable fastener 31 is readily accessible while the engaged with the inflatable watercraft as the bed 14 is laterally integrated into the upper elongated body 12, adjacent to the upper stopper rim 13. Moreover, the upper stopper rim 13 is positioned around the bed 14. In order for the length-adjustable fastener 17 continuously wraps around the upper press 11, the bed 14 is positioned in between the first slot 15 and the second slot 16. The connection between the upper press 11 and the lower press 2 seals the fin box-receiving hole as the length-adjustable fastener 17 is tensionably tethered through the first slot 15, the first track 8, the channel 10, the second track 9, the second slot 16, and the bed 14.

Figure 4:
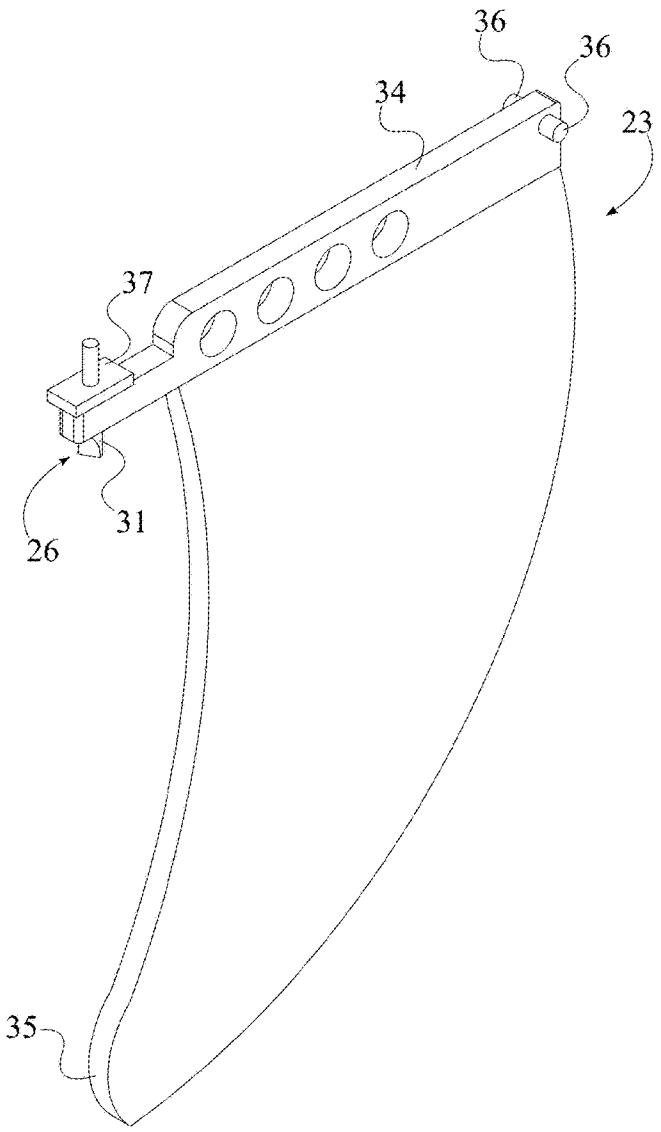
FIG. 4 is a perspective view of a fin and the fin-attachment mechanism of the present invention.

The preferred embodiment of the present invention further comprises a fin-attachment mechanism 26, seen in FIG. 2, FIG. 3, and FIG. 4. The fin-attachment mechanism 26 serves as a universal adapter for a variety of fins. The fin 23 is able to connect with the fin-attachment mechanism 26 as the fin 23 comprises a base edge 34, a pointed end 35, a first slide 36, and a second slide 37. The base edge 34 positions the fin 23 into the fin-receiving slot 7. The pointed end 35 stabilizes the inflatable watercraft while traversing through a body of water. The first slide 36 guides and orients the fin 23 with the lower press 2. The second slide 37 attaches the fin 23 with the lower press 2. The first slide 36 and the second slide 37 are mounted onto the base edge 34, effectively positioning the base edge 34 into the fin-receiving slot 7. The pointed end 35 and the base edge 34 are positioned opposite to each other across the fin 23, preserving the hydrodynamic structure of the fin 23. The entire length of the base edge 34 is positioned within the fin-receiving slot 7 as the first slide 36 and the second slide 37 are positioned opposite to each other along the base edge 34. Moreover, the fin-attachment mechanism 26 is mounted within and along the fin-receiving slot 7. This arrangement provides a secure connection between the fin 23 and the lower press 2 such that the fin 23 is not accidentally separated with the clamp 1 while the inflatable watercraft is in use. In order for a user to easily interchange, install, or remove the fin 23 with the lower press 2, the first slide 36 and the second slide 37 are operatively coupled to the fin-attachment mechanism 26, wherein the fin-attachment mechanism 26 is used to engage or disengage the first slide 36 and the second slide 37.

The fin 23 smoothly latches into the fin-receiving slot 7 as the fin-attachment mechanism 26 comprises at least one lock bar 27, a bridge 28, and a rim extension 29, seen in FIG. 2 and FIG. 3. The at least one lock bar 27 and the bridge 28 are integrated into the lower press 2 as the fin-receiving slot 7 comprises a lower slot end 32 and an upper slot end 33. The at least one lock bar 27 stops the fin 23 from traversing through the fin-receiving slot 7. The bridge 28 connects the at least one bar within the fin-receiving slot 7. The rim extension 29 allows the first slide 36 and the second slide 37 to slide and engage with the fin-attachment mechanism 26. The lower slot end 32 positions the fin 23 within the fin-receiving slot 7, and the upper slot end 33 positions the at least one lock bar 27 within the fin-receiving slot 7. Moreover, the upper slot end 33 is positioned adjacent with the upper press 11, and the lower slot end 32 is positioned adjacent with the lower stopper rim 4. The at least one lock bar 27 is stabilized within the upper slot end 33 as the bridge 28 is centrally positioned within the fin-receiving slot 7, adjacent to the upper slot end 33. More specifically, the bridge 28 is mounted across the fin-receiving slot 7. The at least one lock bar 27 is positioned into the upper slot end 33 and is mounted within the fin-receiving slot 7, against the bridge 28. This arrangement defines the depth the fin 23 may enter into the fin-receiving slot 7. The rim extension 29 is connected within and around the lower slot end 32 in order to engage the first slide 36 and the second slide 37. More specifically, the rim extension 29 is positioned coplanar with the lower stopper rim 4. The first slide 36 and the second slide 37 are pressed in between the rim extension 29 and the at least one lock bar 27, thereby securing the fin 23 into the fin-receiving slot 7.

As seen in FIG. 3, the fin-attachment mechanism 26 further comprises a slide-insertion notch 30, which permits the insertion and removal of the first slide 36 between the rim extension 29 and the at least one lock bar 27. The slide-insertion notch 30 traverses through the rim extension 29 and into the fin-receiving slot 7 so that the first slide 36 slides past the rim extension 29 and the at least one lock bar 27 is able to press against the first slide 36, and consequently the base edge 34 of the fin 23. More specifically, the slide-insertion notch 30 is centrally positioned along the fin-receiving slot 7. This arrangement allows the first slide 36 to be secured between the rim extension 29 and the at least one lock bar 27, regardless of the length of the base edge 34.

In the preferred embodiment of the present invention, the first slide 36 is a pair of pegs, seen in FIG. 4. The pair of pegs balances and orients the base edge 34 between the rim extension 29 and the at least one lock bar 27. The pair of pegs is fixed perpendicular to the base edge 34 and positioned opposite to each other about the base edge 34, reinforcing the structural integrity of the fin 23 with the lower press 2. More specifically, the pair of pegs is positioned colinear to each other and, consequently, the base edge 34 smoothly slides between the rim extension 29 and the at least one lock bar 27.

In the preferred embodiment of the present invention, the fin 23 further comprises a fastener 31, and the second slide 37 is a solid block, also seen in FIG. 4. The fastener 31 is preferably a screw that locks the fin 23 with the solid block. The solid block mounts the fin 23 between the rim extension 29 and the at least one lock bar 27. The second slide 37 is removably attached to the fin 23 by the fastener 31, positioning the entire length of the base edge 34 of the fin 23 along the fin-receiving slot 7.

Figure 5:
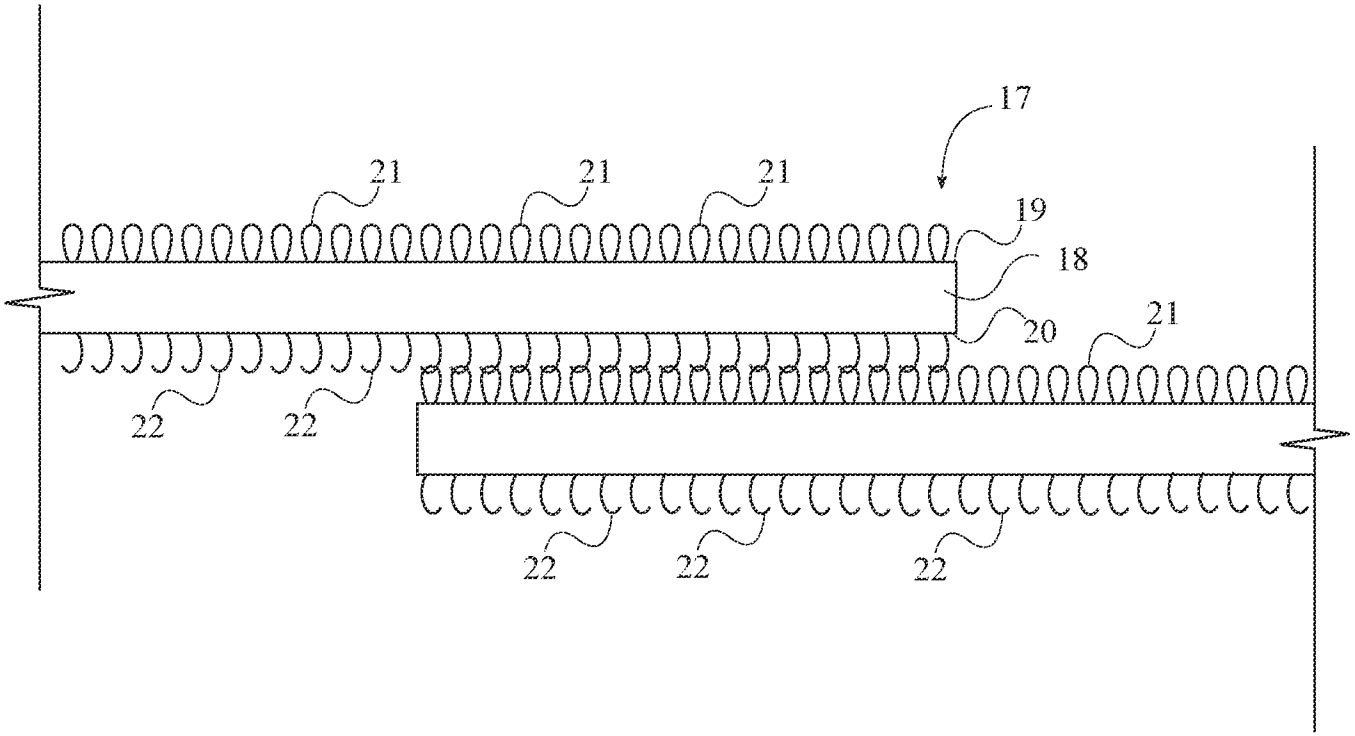
FIG. 5 is a schematic view of a length-adjustable fastener of the present invention.

Furthermore, in the preferred embodiment of the present invention, the length-adjustable fastener 17 is a Velcro strap. The length-adjustable fastener 17 comprises a strap 18, a first surface 19, a second surface 20, a plurality of hooks 21, and a plurality of loops 22, seen in FIG. 2, FIG. 3, and FIG. 5. The strap 18 connects the lower press 2 and the upper press 11 with each other. The first surface 19 upholds the plurality of hooks 21, and the second surface 20 upholds the plurality of loops 22. The first surface 19 is positioned opposite the second surface 20 about the strap 18. The plurality of hooks 21 and the plurality of loops 22 allows the strap 18 to loop and the ends of the strap 18 to attach to each other. The plurality of hooks 21 is distributed across the first surface 19, and the plurality of loops 22 is distributed across the second surface 20. In order for the lower press 2 and the upper press 11 to be tightened with the inflatable watercraft, the length-adjustable strap 18 is arranged into a looped configuration. The plurality of hooks 21 and the plurality of loops 22 are engaged to each other, defining a desired overall length of the length-adjustable strap 18 for the clamp 1 to seal the fin box-receiving hole.

The present invention further comprises a plurality of lower counterforts 24 and a plurality of upper counterforts 25, seen in FIG. 2 and FIG. 7, in order to preserve the hydrodynamics of the inflatable watercraft. The plurality of lower counterforts 24 structurally reinforces the lower press 2 while maintaining a desired light weight. The plurality of lower counterforts 24 is distributed about the lower elongated body 3, reinforcing the connections between the lower elongated body 3, the lower stopper rim 4, the first arm 5, and the second arm 6. More specifically, each of the plurality of lower counterforts 24 is connected in between the lower elongated body 3 and the lower stopper rim 4. Similarly, the plurality of upper counterforts 25 structurally reinforces the upper press 11 while maintaining a desired light weight. The plurality of upper counterforts 25 is distributed about the upper elongated body 12, reinforcing the connection between the upper elongated body 12 and the upper stopper rim 13. More specifically, each of the plurality of upper counterforts 25 is connected in between the upper elongated body 12 and the upper stopper rim 13.

Although the invention has been explained in relation to its preferred embodiment, it is to be understood that many other possible modifications and variations can be made without departing from the spirit and scope of the invention as hereinafter claimed.

What is claimed is:

1. A fin mount for an inflatable watercraft comprises:
a clamp;
a fin;
the clamp comprises a lower press, an upper press, and a length-adjustable fastener;
the lower press comprises a lower elongated body, a lower stopper rim, a first arm, a second arm, and a fin-receiving slot;
the upper press comprises an upper elongated body and an upper stopper rim;
the lower stopper rim being laterally fixed around the lower elongated body;
the first arm and the second arm being laterally fixed to the lower elongated body, opposite the lower stopper rim;
the first arm and the second arm being positioned opposite to each other along the lower elongated body;
the first arm and the second arm being positioned perpendicular with the lower elongated body;
the fin-receiving slot being positioned in between the first arm and the second arm;
the fin-receiving slot traversing through the lower elongated body;
the upper stopper rim being laterally fixed around the upper elongated body;
the upper elongated body being positioned adjacent with the first arm and the second arm, opposite the lower elongated body;
the fin being removably attached into the fin-receiving slot;
the fin being positioned opposite to the first arm and the second arm about the lower elongated body; and,
the upper press and the lower press being tensionably tethered to each other by the length-adjustable fastener.

2. The fin mount for an inflatable watercraft as claimed in claim 1 comprises:
the lower press further comprises a first track, a second track, and a channel;
the upper press further comprises a bed, a first slot, and a second slot;
the first track being integrated along the first arm;
the second track being integrated along the second arm;
the channel being integrated along the lower elongated body;
the channel traversing from the first track to the second track, across the lower elongated body;
the first slot and the second slot traversing through the upper elongated body;
the first slot being positioned opposite the second slot along the upper elongated body;
the bed being laterally integrated into the upper elongated body, adjacent to the upper stopper rim;
the upper stopper rim being positioned around the bed;
the bed being positioned in between the first slot and the second slot; and,
the length-adjustable fastener being tensionably tethered through the first slot, the first track, the channel, the second track, the second slot, and the bed.

3. The fin mount for an inflatable watercraft as claimed in claim 1 comprises:
a fin-attachment mechanism;
the fin comprises a base edge, a pointed end, a first slide, and a second slide;

the first slide and the second slide being mounted onto the base edge;

the pointed end and the base edge being positioned opposite to each other across the fin;

the first slide and the second slide being positioned opposite to each other along the base edge;

the fin-attachment mechanism being mounted within and along the fin-receiving slot; and, the first slide and the second slide being operatively coupled to the fin-attachment mechanism, wherein the fin-attachment mechanism is used to engage or disengage the first slide and the second slide.

4. The fin mount for an inflatable watercraft as claimed in claim 3 comprises:

the fin-attachment mechanism comprises at least one lock bar, a bridge, and a rim extension;

the fin-receiving slot comprises a lower slot end and an upper slot end;

the upper slot end being positioned adjacent with the upper press;

the lower slot end being positioned adjacent with the lower stopper rim;

the bridge being centrally positioned within the fin-receiving slot, adjacent to the upper slot end;

the bridge being mounted across the fin-receiving slot;

the at least one lock bar being positioned into the upper slot end;

the at least one lock bar being mounted within the fin-receiving slot, against the bridge;

the rim extension being connected within and around the lower slot end;

the rim extension being positioned coplanar with the lower stopper rim; and, the first slide and the second slide being pressed in between the rim extension and the at least one lock bar.

5. The fin mount for an inflatable watercraft as claimed in claim 4 comprises:

the fin-attachment mechanism further comprises a slide-insertion notch;

the slide-insertion notch traversing through the rim extension and into the fin-receiving slot; and, the slide-insertion notch being centrally positioned along the fin-receiving slot.

6. The fin mount for an inflatable watercraft as claimed in claim 3 comprises:

the first slide being a pair of pegs;

the pair of pegs being fixed perpendicular to the base edge;

the pair of pegs being positioned opposite to each other about the base edge; and, the pair of pegs being positioned colinear to each other.

7. The fin mount for an inflatable watercraft as claimed in claim 3 comprises:

the fin further comprises a fastener;

the second slide being a solid block; and, the second slide being removably attached to the fin by the fastener.

8. The fin mount for an inflatable watercraft as claimed in claim 1 comprises:

the length-adjustable fastener comprises a strap, a first surface, a second surface, a plurality of hooks, and a plurality of loops;

the first surface being positioned opposite the second surface about the strap;

the plurality of hooks being distributed across the first surface; and, the plurality of loops being distributed across the second surface.

9. The fin mount for an inflatable watercraft as claimed in claim 8 comprises:

wherein the length-adjustable strap is arranged into a looped configuration; and, the plurality of hooks and the plurality of loops being engaged to each other.

10. The fin mount for an inflatable watercraft as claimed in claim 1 comprises:

a plurality of lower counterforts;

the plurality of lower counterforts being distributed about the lower elongated body; and, each of the plurality of lower counterforts being connected in between the lower elongated body and the lower stopper rim.

11. The fin mount for an inflatable watercraft as claimed in claim 1 comprises:

a plurality of upper counterforts;

the plurality of upper counterforts being distributed about the upper elongated body; and, each of the plurality of upper counterforts being connected in between the upper elongated body and the upper stopper rim.

12. A fin mount for an inflatable watercraft comprises:

a clamp;

a fin;

the clamp comprises a lower press, an upper press, and a length-adjustable fastener;

the lower press comprises a lower elongated body, a lower stopper rim, a first arm, a second arm, a fin-receiving slot, a first track, a second track, and a channel;

the upper press comprises an upper elongated body, an upper stopper rim, a bed, a first slot, and a second slot;

the lower stopper rim being laterally fixed around the lower elongated body;

the first arm and the second arm being laterally fixed to the lower elongated body, opposite the lower stopper rim;

the first arm and the second arm being positioned opposite to each other along the lower elongated body;

the first arm and the second arm being positioned perpendicular with the lower elongated body;

the fin-receiving slot being positioned in between the first arm and the second arm;

the fin-receiving slot traversing through the lower elongated body;

the upper stopper rim being laterally fixed around the upper elongated body;

the upper elongated body being positioned adjacent with the first arm and the second arm, opposite the lower elongated body;

the fin being removably attached into the fin-receiving slot;

the fin being positioned opposite to the first arm and the second arm about the lower elongated body;

the upper press and the lower press being tensionably tethered to each other by the length-adjustable fastener;

the first track being integrated along the first arm;

the second track being integrated along the second arm;

the channel being integrated along the lower elongated body;

the channel traversing from the first track to the second track, across the lower elongated body;

the first slot and the second slot traversing through the upper elongated body;

the first slot being positioned opposite the second slot along the upper elongated body;

the bed being laterally integrated into the upper elongated body, adjacent to the upper stopper rim;

the upper stopper rim being positioned around the bed;

the bed being positioned in between the first slot and the second slot; and, the length-adjustable fastener being tensionably tethered through the first slot, the first track, the channel, the second track, the second slot, and the bed.

13. The fin mount for an inflatable watercraft as claimed in claim 12 comprises:

a fin-attachment mechanism;

the fin-attachment mechanism comprises at least one lock bar, a bridge, and a rim extension;

the fin comprises a base edge, a pointed end, a first slide, and a second slide;

the fin-receiving slot comprises a lower slot end and an upper slot end;

the first slide and the second slide being mounted onto the base edge;

the pointed end and the base edge being positioned opposite to each other across the fin;

the first slide and the second slide being positioned opposite to each other along the base edge;

the fin-attachment mechanism being mounted within and along the fin-receiving slot;

the first slide and the second slide being operatively coupled to the fin-attachment mechanism, wherein the fin-attachment mechanism is used to engage or disengage the first slide and the second slide;

the upper slot end being positioned adjacent with the upper press;

the lower slot end being positioned adjacent with the lower stopper rim;

the bridge being centrally positioned within the fin-receiving slot, adjacent to the upper slot end;

the bridge being mounted across the fin-receiving slot;

the at least one lock bar being positioned into the upper slot end;

the at least one lock bar being mounted within the fin-receiving slot, against the bridge;

the rim extension being connected within and around the lower slot end;

the rim extension being positioned coplanar with the lower stopper rim; and, the first slide and the second slide being pressed in between the rim extension and the at least one lock bar.

14. The fin mount for an inflatable watercraft as claimed in claim 12 comprises:

the fin-attachment mechanism further comprises a slide-insertion notch;

the slide-insertion notch traversing through the rim extension and into the fin-receiving slot; and, the slide-insertion notch being centrally positioned along the fin-receiving slot.

15. The fin mount for an inflatable watercraft as claimed in claim 12 comprises:

the first slide being a pair of pegs;

the pair of pegs being fixed perpendicular to the base edge;

the pair of pegs being positioned opposite to each other about the base edge; and, the pair of pegs being positioned colinear to each other.

16. The fin mount for an inflatable watercraft as claimed in claim 12 comprises:

the fin further comprises a fastener;

the second slide being a solid block; and, the second slide being removably attached to the fin by the fastener.

17. The fin mount for an inflatable watercraft as claimed in claim 12 comprises:

the length-adjustable fastener comprises a strap, a first surface, a second surface, a plurality of hooks, and a plurality of loops;

the first surface being positioned opposite the second surface about the strap;

the plurality of hooks being distributed across the first surface; and, the plurality of loops being distributed across the second surface.

18. The fin mount for an inflatable watercraft as claimed in claim 17 comprises:

wherein the length-adjustable strap is arranged into a looped configuration; and, the plurality of hooks and the plurality of loops being engaged to each other.

19. The fin mount for an inflatable watercraft as claimed in claim 12 comprises:

a plurality of lower counterforts;

the plurality of lower counterforts being distributed about the lower elongated body; and, each of the plurality of lower counterforts being connected in between the lower elongated body and the lower stopper rim.

20. The fin mount for an inflatable watercraft as claimed in claim 12 comprises:

a plurality of upper counterforts;

the plurality of upper counterforts being distributed about the upper elongated body; and, each of the plurality of upper counterforts being connected in between the upper elongated body and the upper stopper rim.

* * * * *